A pivoting wand 452 is pivotally mounted 454 to the palletizer frame primary member 254 as illustrated in FIG. 40. An eighth trip sensor 456 is positioned beneath the pivoting wand 452 so as to be actuated by downward movement of the pivoting wand. The length of the wand 452 must be selected as follows.

First, the wand 452 must be of sufficient length such that it only actuates the eighth trip sensor 456 when the end of the wand clears the previously deposited section of boxes or cartons on the truck bed 18 as herein described. So constructed, the wand actuated trip sensor 456 provides the MCU 422 with a signal that the palletizer false floor 262 may be extended as it will clear of the below-adjacent level of boxes or cartons 24 stacked on the bed 19 of the present invention.

In addition, the wand 452 must also be of sufficient length such that when the carriage moves longitudinally along the bed 19 as a result of assembling and stacking a full column of boxes or cartons onto the bed 19 as hereinafter described, the wand actuated trip sensor 456 signals the MCU 422 that the palletizer frame is clear of the assembled column of boxes or cartons 24 on the bed 19, such that the MCU 422 may begin to lower the palletizer frame 250 as described herein, in preparation for resuming the arranging, stacking and palletizing operations of the palletizer.

For purposes of example, for use with standard boxes or cartons 24 of lettuce, it is expected that the wand 452 will be approximately 18 inches in length in the preferred embodiment of the present invention.

Movement of the tamping bar 264 is controlled as follows. As shown in FIG. 56, a ninth rotation trip sensor 458 and a tenth rotation trip sensor 460 are positioned to be actuated by a ninth cam member 462 and a tenth cam member 464, respectively. Each of the cam members are positioned about tamping cam shaft 466 integrally connected to one of the secondary tamping links 304.

In addition, an eleventh trip sensor 468 and a twelfth trip sensor 470 are connected to the palletizer frame 254 through brackets 469 and 471, respectively, so as to extend into the arc of rotation of the tamping bar support cross members 312 and 298, respectively. Under normal operation of the palletizer, the MCU 422 retains the tamping bar 264 in its fully withdrawn or home position as illustrated in solid lines in FIG. 41. When the tamping bar 264 is in the home position, the MCU 422 receives an electronic signal from the eleventh trip sensor 468 as continually actuated by a tab 473 connected to cross member 312.

When the MCU 422 determines that a full row of boxes or cartons 24 is present in the pre-stacking area of the false floor 262, the MCU program directs the tamping bar 264 to extend to a preselected position. If the row of boxes or cartons 24 is arranged longitudinally, the tamping bar 264 will extend until the MCU 422 receives a signal from the ninth roller trip sensor 458, referred to as the first extended position. If the row of boxes or cartons 24 is arranged transversely, the tamping bar 264 will extend until the MCU 422 receives a signal from the tenth roller trip sensor 460, referred to as the second extended position.

For purposes of example, where the present invention is used for loading, stacking and arranging standard boxes or cartons of lettuce, the ninth cam member 462 is arranged to actuate the ninth roller trip sensor 458 when the tamping bar 264 has extended approximately 18 inches. Similarly, the tenth cam member 464 is arranged to actuate the tenth roller trip sensor 460 when the tamping bar 264 has extended approximately 24 inches.

As a result of the above described extension of the tamping bar 264, the row of boxes or containers 24 will be in contact and substantially adjacent to the tailgate 25 of the transloader bed 19 or a previously arranged section of boxes or containers 24.

Subsequently, upon tabulating the electronic signals from the fourth roller trip sensor 434 and determining that a complete second row of boxes or cartons 24 has been assembled in the pre-stacking area of the palletizer false floor 262, thereby completing a section of boxes or cartons 24, the MCU 422 again acts to extend the tamping bar 264. This time, however, since a complete section of boxes or cartons 24 is now present on the pre-stacking area of the false floor 262, the MCU 422 only extends the tamping bar 264 until it receives a signal from the twelfth trip sensor 470, known as the third extended position. As illustrated by FIG. 41, the twelfth roller trip sensor 470 is actuated by tamping bar cross member 298 as it moves along its arc of rotation as the tamping bar 264 is extended.

At this point, the MCU 422 maintains the tamping bar 264 in the third extended position until the MCU 422 receives a signal from the seventh roller trip sensor 446 indicating that the palletizer false floor 262 has been fully retracted. The tamping bar 264 is held in the third extended position to ensure that the just-deposited section of boxes and cartons is fully and properly packed on the pallets 20 and to prevent a condition known in the industry as "flap-to-flap". "Flap-to-flap" occurs when a flap of one box becomes aligned with the flap of an above or below adjacent box. If the "flap-to-flap" condition is not corrected prior to stacking additional cartons or boxes 24 onto the just deposited section of cartons or boxes 24, it is extremely difficult if not impossible to correct without unloading the entire truck.

As a result of the retraction of the palletizer false floor 264, the section of assembled boxes or cartons 24 are allowed to drop the short distance between the level of the palletizer false floor 262 and the below adjacent level of the pallets 20 positioned on the bed 19, or the tops of the below adjacent section of boxes or cartons 24 previously stacked by the palletizer.

Again, for purposes of example only, when loading, arranging and stacking standard boxes or cartons of lettuce, the third extended position is an extension of approximately two inches. Since the amount of movement of the tamping bar 264 between the home and third extended positions is small, the eleventh 468 and twelfth 470 rolling trip sensors are mounted on the palletizer frame and are actuated by the tamping bar cross members 312 and 298, respectively so as to provide the necessary precision required to track such a small movement.

Upon receiving the above-mentioned signal from the seventh roller trip sensor 446 that the false floor 262 is in the fully retracted position, the MCU 422 retracts the tamping bar 264 to the home position. The MCU 422 then engages in a second tamping action by again extending the tamping bar 264 to the third extended position and withdrawing it to its home position. This second tamping action ensures that the boxes or cartons are tightly stacked onto the bed 19.

After completing the second tamping of the boxes or containers 24, the MCU 422 acts to lift the palletizer 14 through the tension members 250 by extending hydraulic cylinder 256 until the MCU 422 receives a signal

APPARATUS FOR CHARGING COMBUSTIBLE MATERIALS

This is a continuation of copending application Ser. No. 06/825,624 filed on Feb. 3, 1986, now abandoned.

BACKGROUND OF THE INVENTION

This invention relates to a feeding apparatus and more particularly to an apparatus for charging an elevated mass of combustible material into a combustion chamber.

In most municipal incinerator facilities, collected refuse to be burned normally is deposited in an elevated holding chamber from where it is gravity fed into a combustion chamber and onto an upper end of a stoker where the refuse is burned. Typically, a mechanism is provided for feeding the refuse from the holding chamber into the incinerator chamber. The principal function of the feeding mechanism is to feed the refuse into the combustion chamber at a controlled rate and to seal the combustion chamber from the holding chamber so that the products of combustion will not escape through the charging chute into the holding chamber.

Most of the mechanisms used in the prior art for feeding refuse from a holding chamber into an incinerator chamber are relatively complicated in design and not entirely satisfactory in performance. It thus has been found to be desirable to provide such a mechanism which is simple in design and more effective in performance.

OBJECTS OF THE INVENTION

Accordingly, it is the principal object of the present invention to provide an improved feeder apparatus.

Another object of the present invention is to provide an improved apparatus from feeding material from one chamber into another.

A further object of the present invention is to provide an improved apparatus for feeding a material from one chamber to another in which the feed rate may be controlled and a seal is formed between the chambers.

A still further object of the present invention is to provide an apparatus for gravity feeding a material from one chamber to another chamber.

Another object of the present invention is to provide an improved apparatus for charging combustible materials into an incinerator.

A further object of the present invention is to provide an improved apparatus for gravity feeding refuse from a holding chamber to an incinerator chamber.

A still further object of the present invention is to provide an improved apparatus for charging refuse from a holding chamber into an incinerator and onto a stoker, in which the refuse may be charged into the combustion chamber at a controlled rate and a seal is formed between the holding chamber and the combustion chamber to prevent the escape of the products of combustion from the combustion chamber into the holding chamber.

Another object of the present invention is to provide an improved apparatus for feeding a material from an elevated chamber to a lower chamber which is relatively simple in design, comparatively inexpensive to manufacture and service and effective in performance.

Other objects and advantages of the present invention will become more apparent to those persons having ordinary skill in the art to which the invention pertains from the following description taken in conjunction with the accompanying drawings.

DETAILED DESCRIPTION OF THE PREFERRED EMBODIMENT

Figure 2:
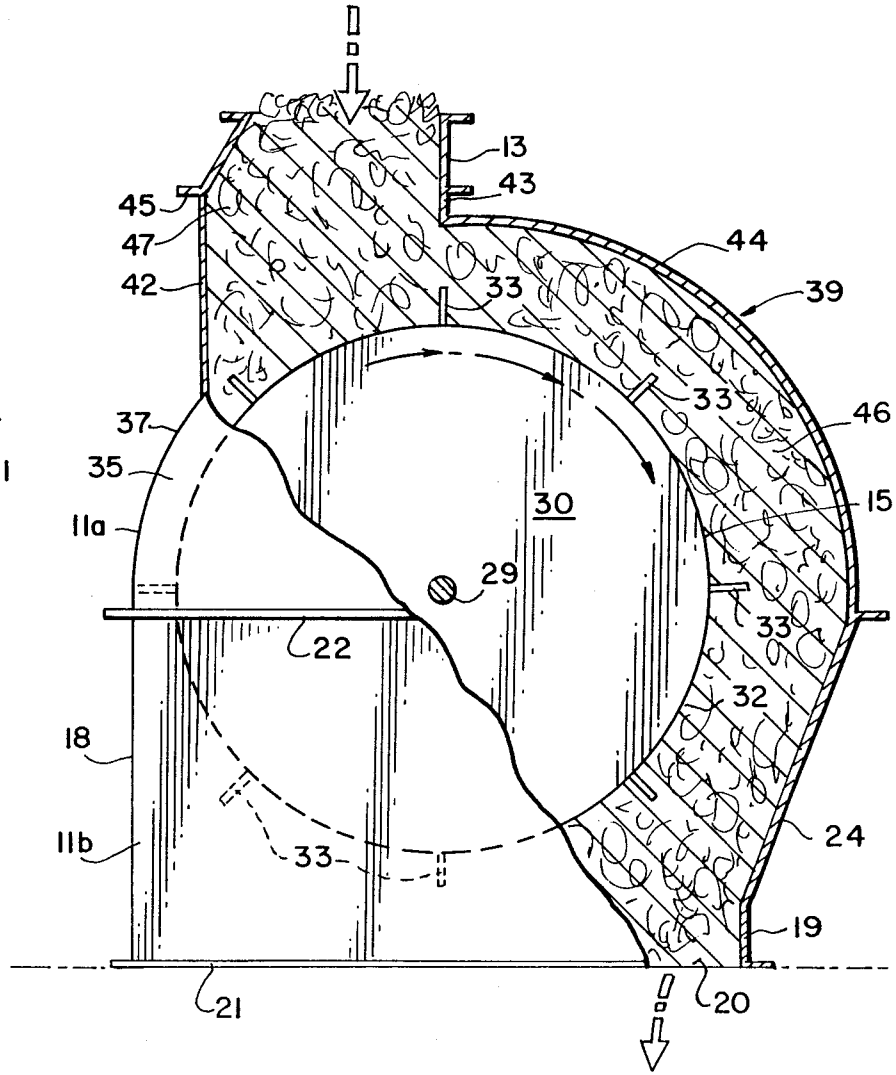
FIG. 2 is an elevational side view of the embodiment illustrated in Figure 1, having a portion thereof broken away.
Figure 1:
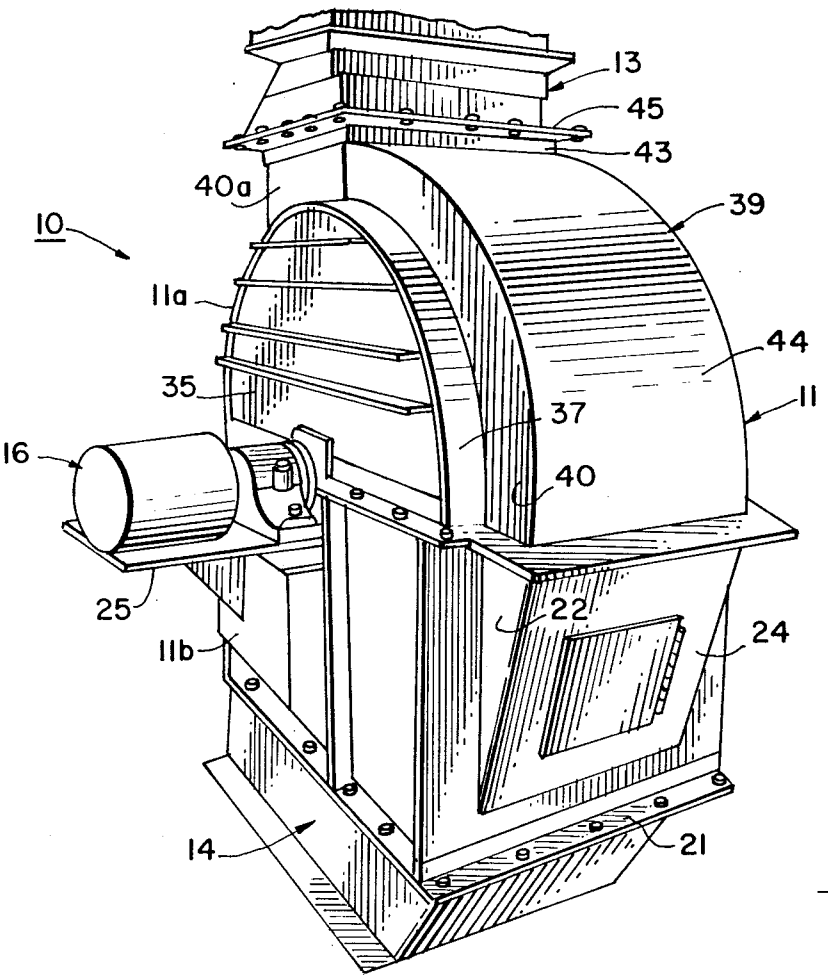
FIG. 1 is a perspective view of an embodiment of the invention.

Referring to the drawings, there is illustrated a feeder apparatus 10 consisting of a housing 11 connectable at its upper end to an upper feed chute 13 and at its lower end to a lower feed chute 14, and a rotatable drum 15 journaled in the housing and driven by a motor 16 through a suitable gear reduction unit. Housing 11 consists of a lower housing section **11*b* connectable to lower feed chute 14 and an upper section 11*a* mounted on the lower housing section and connectable to upper feed chute 13**.

Lower housing section **11*b* is substantially rectangular in configuration including a pair of side walls 16 and 17 and a pair of end walls 18 and 19 providing an open upper end and an open lower end defining an outlet 20. The lower end of housing section 11*b* is provided with a peripherally disposed mounting flange 21 for mounting the lower housing section to lower feed chute 14. The upper end of housing section 11a is provided with a peripherally disposed mounting flange 22 for mounting the upper housing section on the lower housing section. End wall 19 also is provided with a cut -away portion extending downwards from the upper edge thereof which is enclosed by a pair of triangularly shaped side walls 22 and 23 and a sloping end wall 24**.

Figure 3:
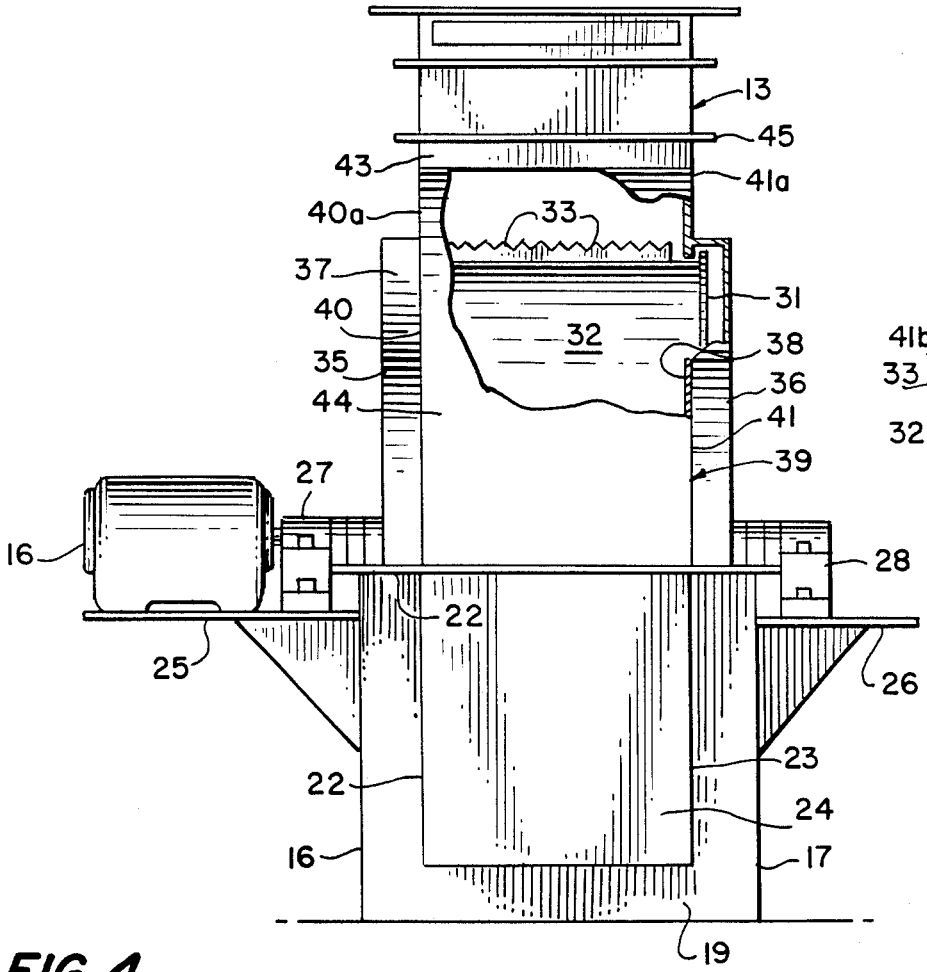
FIG. 3 is an elevational end view of the embodiment shown in FIG. 1 having a portion thereof broken away.
Figure 4:
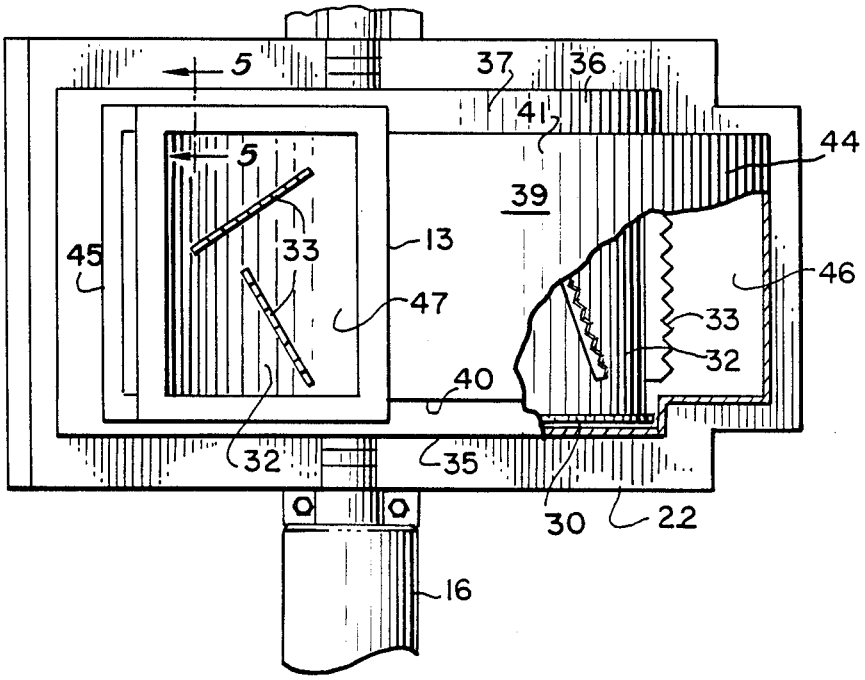
FIG. 4 is a top plan view of the embodiment shown in FIG. 1, having a portion thereof broken away.

As best shown in FIGS. 3 and 4, the upper ends of the side walls of the lower housing section are provided with a set of brackets 25 and 26 on which there is mounted a set of bearings or pillow blocks 27 and 28 in which there is journaled a support shaft 29 of rotatable drum 15. As shown in FIG. 3, one end of the shaft is operatively connected to drive motor 16.

Drum 15 includes a pair of circular side walls 30 and 31 mounted on support shaft 29 and a cylindrical wall 32. The diameters of drum side walls 30 and 31 are slightly greater than the outside diameter of cylindrical drum wall 32 to provide a pair of annular lip portions, such as lip **31*a* in FIG. 5. Rigidly mounted on the cylindrical wall is a plurality of circumferentially spaced paddle-like elements 33 provided with serrated edges 34. As best shown in FIG. 2, the lower end of the drum is disposed in the lower housing section with wall 32 being spaced from sloping wall 24 to provide a passageway therebetween. Cylindrical wall 32 also is spaced from the upper end of end wall 18 of the lower housing section but only by enough to allow clearance of paddle-like elements 33** when the drum is rotated.

Upper housing section **11*a* includes a pair of semi-circular side walls 35 and 36 and an arcuate top wall 37. The outer ends of support shaft 29 of the drum extend through openings in side walls 35 and 36 so that the upper end of the drum will be enclosed by the upper housing section with cylindrical wall 32 of the drum being spaced sufficiently from top wall section 37 of the upper housing section to provide clearance for paddle-like elements 33** when the drum is rotated.

Semi-circular wall 37 is provided with a longitudinally disposed slot or opening 38 which is aligned with the slot or opening in end wall 19 of the lower housing section, and extends approximately 140° measuring in a counterclockwise direction from the plane of the meeting surfaces of the upper and lower housing sections, in reference to FIG. 2. Such slot is enclosed by a projecting portion 39 of the upper housing section which includes a pair of arcuately shaped side walls 40 and 41 lying in the same vertical planes and merging with side walls 22 and 23 of the projecting portion of the lower housing section, a pair of vertically disposed end walls 42 and 43 adjoining upwardly projecting portions 40*a* and 41*a* of side walls 40 and 41, and a curved upper wall 44 extending from end wall 43 to and merging with wall 24 of the projecting portion of the lower housing section. The upper ends of end walls 42 and 43 and upwardly projecting portions 40*a* and 40*b* are provided with a mounting flange 45 for connecting upper housing section 11*a* to upper feed chute 13.

As illustrated in the drawings, cylindrical wall 32 of the drum and the walls of the projecting portions of the housing sections provide a passageway 46 intercommunicating an inlet 47 defined by wall portions 40*a*, 41*b*, 42 and 43 and outlet 20 of housing 11, through which material fed into the apparatus may be conveyed as a result of the rotation of the drum which is operable to rotate in a clockwise direction relative to FIG. 2.

The embodiment as described is intended to be installed in a facility wherein a supply of combustible material such as refuse may be fed into upper feed chute 13 by means of a delivery conveyor or a crane, onto the drum, advanced through passageway 46 and discharged through lower feed chute 14 into a combustion chamber.

In the operation of the embodiment as described, combustion material such as refuse will gravity fall from an elevated conveyor or a crane through upper feed chute 13 and inlet 47 of projected portion 39 and be deposited on the peripheral surface of the drum. As the drum is rotated in a clockwise direction relative to FIG. 2, the paddle-like elements on the periphery of the drum will cause material deposited on the drum to be conveyed through passageway 46 and discharged through outlet 20 of the lower housing section and lower feed chute 14 into the incinerator. The feed rate of the apparatus may be controlled by controlling the speed of rotation of the drum. Whether or not the drum is rotating, the accumulation of material deposited on the drum through upper feed chute 13 will form a seal between inlet 47 and outlet 20 to prevent any of the products of combustion emanating in the combustion chamber from flowing through the feeder apparatus into the holding chamber. Such seal also will function to prevent a heat loss through the feeder apparatus.

Figure 5:
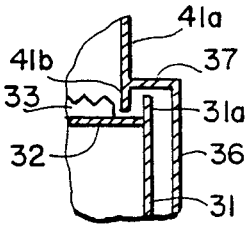
FIG. 5 is an enlarged cross-sectional view taken along line 5—5 in FIG. 4.

As best shown in FIG. 5, the lower ends of walls 40*a* and 41*a* project downwardly into the upper housing section and terminate above wall 32 of the drum so that the upper ends of lip portions 30*a* and 31*a* will be disposed between depending portions 40*a* and 41*a*. Such arrangement provides tortuous paths between inlet 47 and the side walls of the upper housing section to prevent refuse from flowing laterally and downwardly through the clearance space provided between the side walls of the drum and the side walls of the housing.

It is preferred that the various sections of the apparatus as described be of a welded steel construction. It further is preferred that the components of the apparatus including the upper and lower housing sections, the drum and the upper and lower feed chutes be of a modular construction to facilitate manufacture, shipping and installation. Such components may be assembled either by bolting or welding. The sizing of the components will depend on a number of factors including the clearance provided between the holding and incinerator chambers, the desired feed rates and possibly the nature of the combustible material to be fed by the apparatus. Upper and lower feed chutes 13 and 14 may be fabricated in a manner to permit adaptation to different arrangements in different facilities.

Preferably, inlet 47 should be disposed to one side of the axis of rotation of the drum and passageway 46 should be disposed on an opposite side of such axis, and the cross-sectional area of passageway 46 should increase progressively to maximize the sealing effect provided by the combustible material and allow the free movement of the material through passageway 46. Inlet 47 may be positioned further to the right relative to FIG. 2 but only to the extent that the material gravity fed through inlet 47 will deposit and accumulate on the surface of the drum to provide the required seal between the inlet and outlet of the housing.

From the foregoing detailed description, it will be evident that there are a number of changes, adaptations and modifications of the present invention which come within the province of those persons having ordinary skill in the art. However, it is intended that all such variations not departing from the spirit of the invention be considered as within the scope thereof and as limited solely by the appended claims.

I claim:

1. An apparatus for feeding refuse generally consisting of a non-homogeneous, coarsely shredded and compressible mass of material into an incinerator comprising:

a housing having a charging inlet communicable with a source of supply of said material and a discharge outlet communicable with an incinerator chamber, rotatable means journaled in said housing, said charging inlet being disposed relative to said rotatable means for guiding said material from said source of supply onto a continuous cylindrical surface of said rotatable means, said housing having a wall portion spaced from the periphery of said rotatable means defining a passageway intercommunicating said charging inlet and said discharge outlet, said charging inlet having at least a portion thereof of expanding cross-sectional area to allow material traversing therethrough to expand in volume and fill the lower end thereof, forming a seal between said inlet and said passageway, said passageway having an inlet portion having a cross-sectional area sufficiently large whereby upon said material being guided through said charging inlet and deposited on said rotatable means, forming said seal, will be caused to advance into and through said passageway without being sheared and free-fall through said discharge outlet, said passageway having a cross-sectional area that increases from said charging inlet to said discharge outlet to facilitate the passage of said material therethrough, the periphery of said rotatable means including a plurality of paddle-like elements for advancing said material through said passageway, and wherein said paddle-like elements lie in planes disposed at acute angles relative to the axis of rotation of said rotatable means.

2. An apparatus according to claim 1 wherein said charging inlet is disposed on one side of the axis of rotation of said rotatable means.

3. An apparatus according to claim 2 wherein said charging inlet is disposed on one side of the axis of said rotation of said rotatable means and said passageway is disposed on an opposite side of said axis.

4. An apparatus according to claim 1 wherein said passageway is arcuate.

5. An apparatus according to claim 1 wherein said paddlelike elements are provided with serrated edges.

6. An apparatus for feeding refuse generally consisting of a non-homogeneous, coarsely shredded and compressible mass of material into an incinerator comprising:

a housing having a pair of side walls and pair of end walls, a drum disposed in said housing and journaled in said side walls for rotation about a horizontal axis, said housing having a charging inlet at an upper end thereof communicable with a source of supply of said material and a discharge outlet at a lower end thereof communicable with an incinerator chamber, said charging inlet being disposed relative to said drum for guiding said material onto a continuous cylindrical surface of said drum, said housing having an end wall having a portion spaced closely adjacent to said cylindrical surface of said drum and an end wall spaced from said cylindrical surface of said drum defining a passageway intercommunicating said charging inlet with said discharge outlet, said charging inlet having at least a portion thereof of expanding cross-sectional area to allow material traversing therethrough to expand in volume and fill the lower end thereof, forming a seal between said inlet and said passageway, said passageway having an inlet portion having a cross-sectional area sufficiently large whereby upon said material being guided through said charging inlet and deposited on said drum, forming said seal, will be caused to advance into and through said passageway without being sheared and free-fall through said discharge outlet, said passageway having a cross-sectional area that increases from said inlet to said outlet to facilitate the passage of said material therethrough, the periphery of said drum including a plurality of paddle-like elements for advancing said material through said passageway, and wherein said paddle-like elements lie in planes disposed at acute angles relative to the axis of rotation of said drum.

7. An apparatus according to claim 6 wherein said charging inlet is disposed on one side of the axis of rotation of said drum.

8. An apparatus according to claim 6 wherein said charging inlet is disposed on one side of the axis of rotation of said rotatable means and said passageway is disposed on an opposite side of said axis.

9. An apparatus according to claim 6 wherein said passageway is arcuate.

10. An apparatus according to claim 6 wherein said paddle-like elements are provided with serrated edges.

* * * * *